US005493481A

United States Patent [19]

Wiegand

[11] Patent Number: 5,493,481

[45] Date of Patent: Feb. 20, 1996

[54] BANKLIGHT AND METHOD OF GRADATED DIFFUSE LIGHTING

[76] Inventor: Gregory P. Wiegand, P.O. Box 494, Poulsbo, Wash. 98370

[21] Appl. No.: 7,349

[22] Filed: Jan. 21, 1993

Related U.S. Application Data

[60] Continuation-in-part of Ser. No. 899,609, Jun. 15, 1992, abandoned, which is a division of Ser. No. 470,853, Jan. 26, 1990, Pat. No. 5,122,940.

[51] Int. Cl.[6] ..... F21V 21/00

[52] U.S. Cl. ..... 362/249; 362/243; 362/245; 362/246; 362/251

[58] Field of Search ..... 362/3, 8, 11, 12, 362/13, 16, 17, 234, 235, 240, 243, 244, 245, 246, 249, 251, 352, 355, 357, 290

[56] References Cited

U.S. PATENT DOCUMENTS

| | | | |
|---|---|---|---|
| 2,831,104 | 4/1958 | Brandt | 362/16 |
| 3,194,954 | 7/1965 | Locke | 362/290 |
| 3,996,458 | 12/1976 | Jones et al. | 362/290 |
| 4,045,665 | 8/1977 | Williams et al. | 362/355 |
| 4,271,408 | 6/1981 | Teshima et al. | 362/800 |
| 4,404,619 | 9/1983 | Ferguson | 362/249 |
| 4,409,646 | 10/1983 | Baliozian | 362/17 |
| 4,446,506 | 5/1984 | Larson | 362/17 |
| 4,855,874 | 8/1989 | Waltz | 362/16 |
| 5,023,756 | 6/1991 | Regester | 362/16 |

FOREIGN PATENT DOCUMENTS

| | | | |
|---|---|---|---|
| 33544 | 7/1908 | France | 362/235 |
| 2316532 | 1/1977 | France | 362/355 |

*Primary Examiner*—Ira S. Lazarus
*Assistant Examiner*—Y. Quach
*Attorney, Agent, or Firm*—Patrick M. Dwyer

[57] ABSTRACT

A banklight 10 with a frame 20, a primary diffusing panel 11 stretched across the front of frame 20, a reflecting panel 12 stretched across the rear of frame 20, a secondary diffuser 13 across the frame between the primary diffusing panel 11 and the reflecting panel 12, a light source row 14 along at least one side of the reflecting panel 12 between the reflecting panel 12 and the secondary diffuser 13. The frame is rectangular and is open along the front and rear portions, and the frame is comprised of a plurality of truss members 24. An alternate embodiment of banklight 10 with frame 107, a primary diffuser 108 across front of frame 107, a reflecting panel 104 across rear of frame 107 and over each of multiple light bars 103, each light bar 103 with multiple light sources 101, and a secondary diffuser 106 across frame 107, with secondary diffuser 106 and reflecting panel 104 connected at uniform intervals by side wall diffusing panels 105, to form a series of prismoid tubular gradation cells 100.

12 Claims, 10 Drawing Sheets

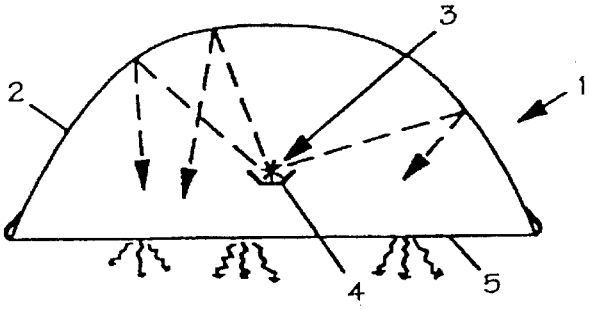
FIG.11 [prior art]
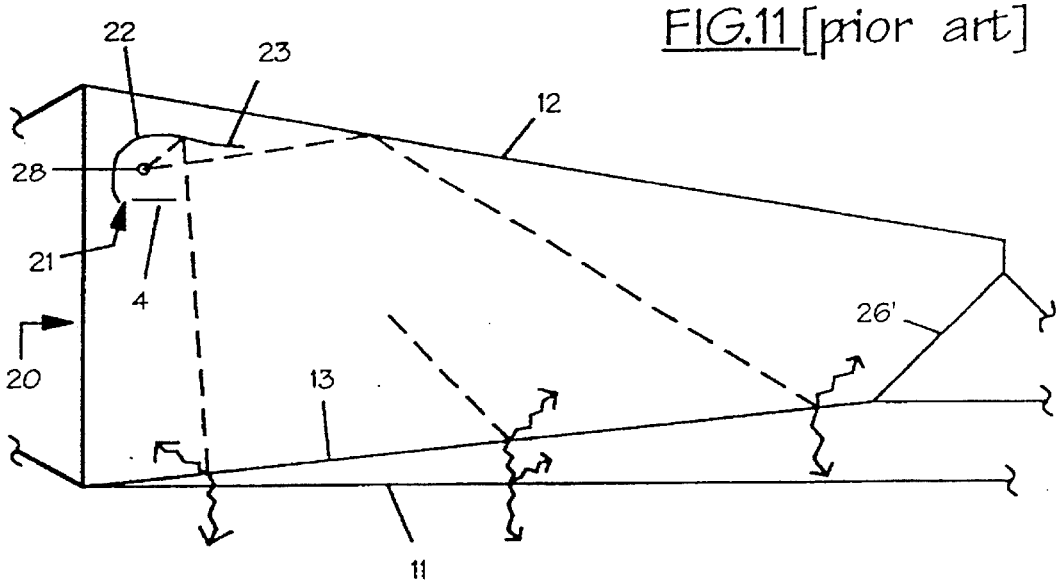
FIG.9
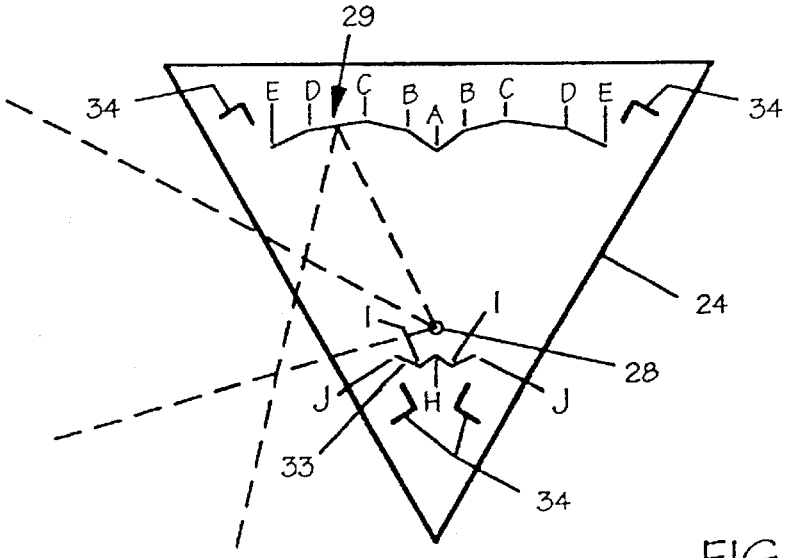
FIG.8

BANKLIGHT AND METHOD OF GRADATED DIFFUSE LIGHTING

This is a Continuation-in-Part of application Ser. No. 07/899,609 filed Jun. 15, 1992, now abandoned, which is a Division of application Ser. No. 07/470,853 filed Jan. 26, 1990, now issued as U.S. Pat. No. 5,122,940 on Jun. 16, 1992.

TECHNICAL FIELD

This invention relates to an apparatus and method for uniform diffuse illumination of objects, and for gradated and/or variegated diffuse illumination of objects. More particularly, the invention relates to a banklight apparatus and a method for uniform diffuse, and for gradated and/or variegated diffuse, illumination of large photographic subjects.

BACKGROUND OF THE INVENTION

The need for an apparatus capable of diffusely illuminating a variety of objects and subjects is well known. See for instance U.S. Pat. Nos. 4,335,421 and 4,669,031, respectively disclosing apparati for illuminating x-ray negatives from behind or photographic subjects directly, and discussing other uses such as illuminated tracing tables. All of these applications require either a diffusely illuminated surface (for lighting from behind) or a surface which radiates a diffuse light for direct illumination. A number of apparati have been proposed to suit these applications. See for instance the U.S. patent numbers referenced above.

In the photographic industry, particularly in that branch of the industry dealing with the photography of large subjects for advertising or editorial purposes such as for display quality photographs of new automobiles, an apparatus generally referred to as a banklight or softlight is employed. These banklights are generally large compared to other lighting fixtures, as they are generally in the size range of ten feet wide by thirty feet long, although both larger and smaller versions are also known. Conventional banklights are known to produce an approximation of diffuse light, but they are large, cumbersome, and time consuming in set-up and takedown, and therefore very expensive to operate. One such conventional banklight apparatus in shown generally in cross-section in FIG. 11. The reflective surface of such a banklight may be a parabolic, ellipsoidal, or circular curve, and the light source schematically shown is typically a line of photo flashtubes or quartz halogen lamps. The diffusing fabric attempts to make up for the nonuniformity of the reflected light rays coming from the reflecting surface, but is only partially successful in doing so.

Intensity of a light source is normally measured with an incident light meter, a meter made to average the amount of light which is striking the meter at any given moment. In the case of a banklight, which is a diffused light source, the amount of light radiating from it is a function of how much light is inside the banklight, factored by the efficiency of the reflector system and the degree to which light is diffused as it passes through the diffusion medium. The outer or primary diffuser is usually considered the front of the banklight.

When discussing light output or intensity from a banklight, it will be useful to limit these terms to the amount of light passing through the outer or primary diffuser, and to speak in terms of the particular light output at any one point on the diffuser, say from a one square inch patch. Such output could be measured with an incident light meter, especially if equipped with a flat light collector, and if held on the spot on the diffuser to be measured. However, the use of a reflective spot meter will be both more convenient and more precise. This type of meter measures the amount of light being reflected off an object. For a banklight, it is appropriate to consider the light coming through a diffuser, especially the primary diffuser, the same as the light reflecting off a white card. Reflective spot meters are optical instruments which require that one look through the lens, and they typically measure the light reflected from a small area, equal to about 1 degree of the field of view. Use of a spot meter has an additional benefit: the spot meter "sees" the diffusion just as a human eye would. Most available diffusion materials are woven fabrics, and to some extent (though calendarization can ameliorate this effect) one can "see" through the weave to the undiffused light within. Since the apparent surface intensity is thus affected to a small extent by the intensity of what is behind the diffuser, the use of a spot meter can provide a more precise estimate of actual available light, and the quality of that light.

Treating the diffuser as if it were a white object reflecting light is important. Banklights not only provide the incident light which illuminates the object being photographed; in the case of automobiles and other highly reflective objects, the diffusion area of the banklight is reflected in the car, and is readily visible in the highlight areas of the object. Therefore, to have the greatest control of the final look of the object in the photograph, it is extremely important to have a banklight with the capability of being gradated, or even variegated and gradated, to maximize the range of possible tonal qualities present in the object in the photograph, without having stark (ungradated) intensity boundaries show up as reflection aberrations in the object in the photograph.

None of the known apparati are capable of quick and easy set-up and take down and none of them are well adapted for banklight configurations as large as eighteen by forty-eight feet, or even larger. In addition none of the known systems employ multiple lines of light sources, each line independently controlled so as to produce, when desired, a gradual and uniform variation of light intensity across the surface of the light fixture, and no known apparatus employs a system of reflecting and diffusing panels to achieve, as desired, either a virtually uniform diffusion of light, or a controlled gradation of diffuse light, while at the same time achieving a very low ratio of thickness of the apparatus to its width. No known banklights employ a plurality of individually controlled light sources and gradation cells to selectably achieve uniform diffusion or intensity/color gradations across the banklight, or variegated color/intensity patterns with gradated boundary zones at the primary diffuser.

DISCLOSURE OF THE INVENTION

Accordingly it is an object of the invention to provide an apparatus and method which can be used for a wide range of applications requiring either a diffusely illuminated surface, or a lighting fixture capable of projecting either uniformly diffuse light or controlled gradations of diffuse light.

It is a further object to provide such an apparatus which has a low ratio of thickness to width, while at the same time maintaining a virtually uniform diffusion of light at its primary diffusing surface.

It is a more particular object of the invention to provide a banklight apparatus which can produce a virtually uniform diffusion of light at its flat diffusing surface for illuminating objects, such as for photography, but which is alternatively capable of being controlled so that the intensity of light, or color, or both, across the diffusing surface of the apparatus of the invention may be selectably varied from side to side, from end to end, or be localized in subareas of the diffuser.

It is a further object of the invention to provide a banklight apparatus as described above which is capable of relatively quick and easy set-up and take-down which can be collapsed and stored and transported in a size much smaller than it occupies when in use.

More particularly, it is an object of the invention to provide a banklight apparatus employing reflecting and diffusing panels stretched across a frame comprised of triangular trusses.

It is another object of the invention to provide a banklight with a plurality of individually controlled light sources and gradation cells to selectably achieve uniform diffusion or intensity/color gradations across the banklight, or variegated color/intensity patterns with gradated boundary zones at the primary diffuser.

These and other objects of the invention which will become apparent are accomplished by the means and in the manner herein set forth. The apparatus of the invention comprises two or more light source rows and an assembly of reflecting and diffusing panels stretched across an open frame. A reflecting panel is disposed across the rear of the frame, a primary diffusing panel is disposed across the front of the frame, and one or more secondary diffusers are disposed across the frame and between the reflecting panel and the primary diffusing panel. Preferably, the frame is more or less rectangular in dimension and comprised of triangularly cross sectioned truss sections, and the panels are therefore also preferably rectangular in shape to conform to the general shape of the frame. Each light source row, or light bar, preferably has its own associated reflector. In one embodiment, the light source rows are preferably positioned at or near the long edges of the reflecting panel, and preferred reflectors serve principally to direct light across the reflecting panels from both edges so as to provide at the primary diffusing panel a uniform distribution of light intensities. The shape, positioning, and aiming of reflectors is empirically derived for each type and size of banklight with a mind toward maximizing this uniform distribution. This derivation may readily be accomplished by methods well known to persons skilled in the art.

In another embodiment, the light bars run preferably across the width of the rectangular frame and are equally distributed along the long axis of the frame. The reflecting panel is disposed over the tops of the light bars and connected between each bar to a secondary diffuser by a preferably parallel array of side wall diffusing panels, so as to define between each successive pair of side walls, and between the reflecting panel and the secondary diffuser, a plurality of gradation cells, each cell symmetrical along either side of a plane passing perpendicularly through its associated light bar.

The method of the invention comprises the following steps: first, light is directed from a plurality of light source rows toward a reflecting panel which is so disposed in relation to a secondary diffuser that the directed light is reflected by the reflecting panel onto the secondary diffuser; light which passes through the secondary diffuser then strikes a primary diffusing panel disposed to receive and further diffuse the light from the secondary diffuser. An alternate method employs internally illuminated gradation cells made up of side wall diffusing panel connected subportions of the reflecting panel and a secondary diffuser, and independent light intensity or color control for each light source.

In general a panel of light reflecting material is disposed across the rear of the frame and serves as the primary reflecting surface for the apparatus with respect to light coming from light sources disposed in front of the reflecting panel. A panel of diffusing material is disposed across the front of the frame and serves as the primary diffuser for the apparatus. Disposed between the primary diffusing panel and the reflecting panel is a secondary diffuser. In preferred embodiments, this secondary diffuser is not parallel to the other panels but is disposed at angles to the other panels by means of one or more yokes, or by means of gradation side wall diffusing panels, described below.

In simpler embodiments of the apparatus of the invention, there will be one each of the above three described panels, disposed and arranged as described above. In other embodiments, however, there may be more than one of the reflecting panels and sometimes more than one of the secondary diffusers or the reflecting panels and/or secondary diffusers will be comprised of more than one plane surface. A need for multiple reflecting panels or planes and/or secondary diffusers will typically arise where banklights wider than ten feet are built, where for structural engineering reasons which will be apparent to those skilled in the art, and to maintain the low ratio of thickness of the apparatus to its width, an additional central longitudinal truss member is added to the apparatus, thereby creating a pair of rear frame openings while at the same time preserving a single front frame opening. Multiple planes or panels,even without a central truss, will also be effective in achieving optimum variegation/gradation effects.

In center truss embodiments, the front frame opening will be covered as in other embodiments by a single primary diffusing panel, but each of the rear frame openings will have its own reflecting panel. Since ideally in some embodiments each reflecting panel should have disposed along both of its longer outer edges a light source row, in these larger embodiments a third light source row runs within the added central longitudinal truss member. Thus each of the two reflecting panels on these larger embodiments has two light source rows, one along each of its long sides. Of course, the light source row within the additional truss member serves a common function as a light source row for both reflecting panels.

In some embodiments, each apparatus employs one or more yokes of material for the correct shaping and spacing of the secondary diffuser and of the reflecting panel with respect to one another. These yokes interengage both the reflecting panel and the secondary diffuser in such a way as to create empirically the proper geometry for reflection and diffusion for a particular light source and reflector placement within the apparatus. Generally a single yoke is sufficient for apparati of up to ten feet in width of primary diffusing panel, whereas generally wider apparati will benefit from two or more reflecting panels and two or more such yokes. In an enhanced gradation banklight embodiment, it is the side wall diffusing panels that interengage both the reflecting panel and the secondary diffuser in such a way as to create empirically the proper geometry for reflection and diffusion for a particular light source and reflector placement within the apparatus.

Where two or more yokes are employed, either as a matter of design choice, or in order to facilitate a wider apparatus as discussed above, as for instance for an eighteen foot wide apparatus in one embodiment, there is a central longitudinal region of the frame in which a longitudinal truss member is disposed for greater torsional rigidity and stability of the apparatus, and in which to mount a third light source row running along the length of the apparatus. This third light source row has its own, and somewhat differently shaped reflector, in that it is comprised of both a bottom reflector to prevent direct spillage of light to the diffusing medium below and a longitudinally symmetrical gull wing shaped reflector for initially directing the light from the light source to either side of the central truss member.

In one embodiment, light emitted from the two light source rows, each disposed along either long side of the frame, is initially reflected and directed rearwardly and centrally toward the reflecting panel by the reflector associated with each respective light source row. Light reflected forwardly from the reflecting panel then strikes the secondary diffuser. Because of typical light handling properties of diffusive materials, approximately half of the light incident to the secondary diffuser is reflected back toward the reflecting panel and is thus reflectively recycled for additional diffusive effect. The light which passes through the secondary diffuser illuminates the primary diffusing panel and is thereby further diffused.

In preferred embodiments the above mentioned yokes, which will be formed as more particularly described further herein, are dihedral in structure. The vertex of the dihedral is attached to the longitudinal centerline of the reflecting panel and the out two edges of the dihedral are attached symmetrically to the secondary diffuser. In preferred embodiments the yoke is a dihedral of two composite fabric panels, each composite fabric panel composed of alternating sections of diffusing material and mesh material so disposed along both composite panels that a mesh section on one panel of the dihedral is generally opposed by a diffusing fabric section on the other panel of the dihedral. Thus convection cooling air is free to pass and circulate from side to side of the apparatus through the mesh sections, but light is not free to pass undiffused from one side of the yoke to the other.

It will be appreciated, especially where convection cooling is not regarded as an important factor, that the dihedral panels of the yoke need not contain any mesh. This preferred configuration for the yoke is generally used in combination with light source rows placed relatively rearwards and at the edges of the reflecting panels, each with a reflector shaped and positioned to direct light emitted by the light source row rearwardly and towards the center of the reflecting panel and toward the yoke, and also positioned to avoid casting a shadow on the primary diffusing panel.

This preferred configuration of the yoke provides optimum blending of light intensities measured along the width of the primary diffusing panel on either side of the yoke, and provides the best performance during both uniform diffusion illumination with the apparatus and illuminations with the apparatus requiting a gradation in light intensity across the surface of the primary diffusing panel.

Alternate yoke configurations which have been considered and tested, but which yield less than optimum performance are as follows: 1) a simple sewn seam along the longitudinal centerline of the reflecting panel so as to join the reflecting panel to the secondary diffuser along that seam; and 2) a yoke substantially as described above for preferred embodiments except that the vertex of the yoke is attached to the longitudinal centerline of the secondary diffuser instead of to the reflecting panel, and the outer two edges of the yoke are attached to the reflecting panel. Method (1) exhibits relatively poor blending during gradation of the light, and the area immediately forward of the intersection of the reflecting panel and the secondary diffuser lacks sufficient illumination to achieve an overall evenness of ±15% during uniform light production modes. Method (2) does achieve sufficient (±15%) center illumination, however it also suffers from poor blending during gradation modes. To optimize the performance of method (2), the light source row must be relatively forward and near to the outer edges of the primary diffusing panel in order to maintain the proper incident angle of light with respect to the yoke. This positioning however interferes with the primary diffusing panel in that it tends to cause a shadowing of the diffusing panel by hindering light that comes from the reflecting panel and passes through the secondary diffuser from striking and smoothly blending with the outer edges of the primary diffusing panel.

As alluded to above, the apparatus of the invention may be employed in two basic modes of operation. In two light row embodiments, when the light intensities of the two light source rows are equal or nearly equal (uniform mode) the primary diffusing panel will appear, when viewed from in front of the apparatus, to be an evenly and uniformly luminous light source. In preferred embodiments a uniformity of light intensity at the primary diffusing panel of ±10% or better can be regularly achieved with respect to any particular square inch of the primary diffusing panel. When one of the two light source rows is at an intensity of light greater than the other light source row (gradation modes) it will produce a gradual variation of intensity across the primary diffusing panel, with the long edge of the diffusing panel closest to the most intense light source row being brightest. Controlling the ratio of light from one light source row with respect to the other row by independently controlling each row will control the amount of gradation across the surface of the primary diffusing panel. In practice, even without gradation cell enhancements, it has been found that gradation ratios as great as 64:1 can be achieved across the width of the primary diffusing panel.

In a preferred embodiment each light source row is also provided in a conventional manner with a conventional color filtering medium and, where two different color filtering media are employed for the two light source rows, color cross fading with the banklight apparatus will also be possible, as will be readily appreciated by those skilled in the art. One anticipated application of color filtering media, with the banklight apparatus of the invention in its uniform illumination mode of operation, is use of the banklight as what is known in the film industry as a croma key blue screen.

In general, while it is possible to obtain useful performance in the apparatus without the use of reflectors associated with individual light source rows, superior performance is achieved by the use of reflectors fashioned to direct the light from a light source row in such a way as to take advantage of the overall geometry of the combination, on one side of the apparatus, of the reflecting panel, yoke, and secondary diffuser system. Preferred reflector considerations are further disclosed herein.

The edges of the panel materials which engage the frame are preferably scalloped with parabolically cut scallops and then either taped or grommeted at the vertices, or intersection points, of the various parabolic curves of the scallop cuts for quick and easy attachment of the panel material to the frame. The use of these parabolic scallops allows quick and easy stretching of the fabric across the frame in a virtually wrinkle free alignment. This attachment method also makes the panels easily removable so that the panel material may be folded or rolled and stored for transportation. The parabolic scallop cuts at the edges of the panels also allow for convection cooling of the light sources by permitting a flow of cooling air from outside the banklight to pass in and out through the scallop cuts and across the light source areas.

Any frame may be employed in the invention which allows a material to be stretched across it into a substantially planar configuration. Many such frame designs will occur to those skilled in the art. The inventor has found it useful to employ a rectangularly shaped frame as described above which is comprised of individual triangularly cross sectioned truss sections. The positioning of the various truss members within the truss section are accomplished according to methods and calculations well known in the art. A triangularly cross sectioned truss is preferred over a rectangularly cross sectioned truss because less light is reflected back to the subject (that is, light which is subject to spill from the parabolic openings at the edges of the panels), and also because of its better strength to weight ratio.

In preferred embodiments, the truss frame is in turn attached to a suspension cross piece which is itself capable of being suspended, by a suitable line or cable, from a single point. The suspension cross piece is mounted to the frame in such a way and in such a position that it occupies a latitudinal centerline of gravity across the two longer sides of the rectangular frame so that the frame hangs relatively horizontally with respect to the position of its two shorter ends. The preferred suspension system for the banklight apparatus employs a moveable carriage on a suspension cross beam, the carriage preferably having a roller at the suspension system hangpoint over which the suspension cable passes on its way to a takeup winch mounted upon the cross piece. Preferably, a second cable is attached to a sliding carriage and runs to a second takeup winch.

The suspension system provides a winch which controls a cable attached to the movable carriage to adjustably change the position of the carriage along the suspension cross piece and thus shift the hang point in relation to the banklight center of inertia so that the whole bank light assembly is able to rotate through a range of positions from parallel to the ground through positions nearly perpendicular to the ground, but without substantially changing the actual height of the center of inertia of the banklight itself. The suspension system provides for the raising and lowering of the center of inertia of the banklight by means of the other winch whose cable passes over the roller on the carriage. In banklight embodiments of width great enough to require the use of a longitudinal central truss member, the suspension cross piece may be a system of trusses itself, and in any case the exact structural nature of the suspension cross piece may be varied without departing from the scope of the invention.

Other features of this apparatus are its inherently self-baffled design which allows sufficient cooling of the light sources by convection only, while also directing resultant light spill in a direction generally opposite that of the primary diffuser, so as to avoid any unwanted light spill on the photo subject. Reflector assemblies are associated with the rows of light sources which are connected to an electrical bus bar which is common to the reflector/truss sections and which is interconnected upon assembly of the banklight.

BRIEF DESCRIPTION OF THE DRAWINGS

FIG. 8 is a schematic cross sectional detail of the lamp and reflector structure within the central truss member of FIG. 6.

FIG. 9 is a schematic cross sectional detail of an alternate embodiment of the apparatus of FIG. 1 depicting placement of the light source row and reflector in an alternate location in the apparatus.

FIG. 11 is a schematic end section of a conventional banklight apparatus.

BEST MODE FOR CARRYING OUT THE INVENTION

Figure 1:
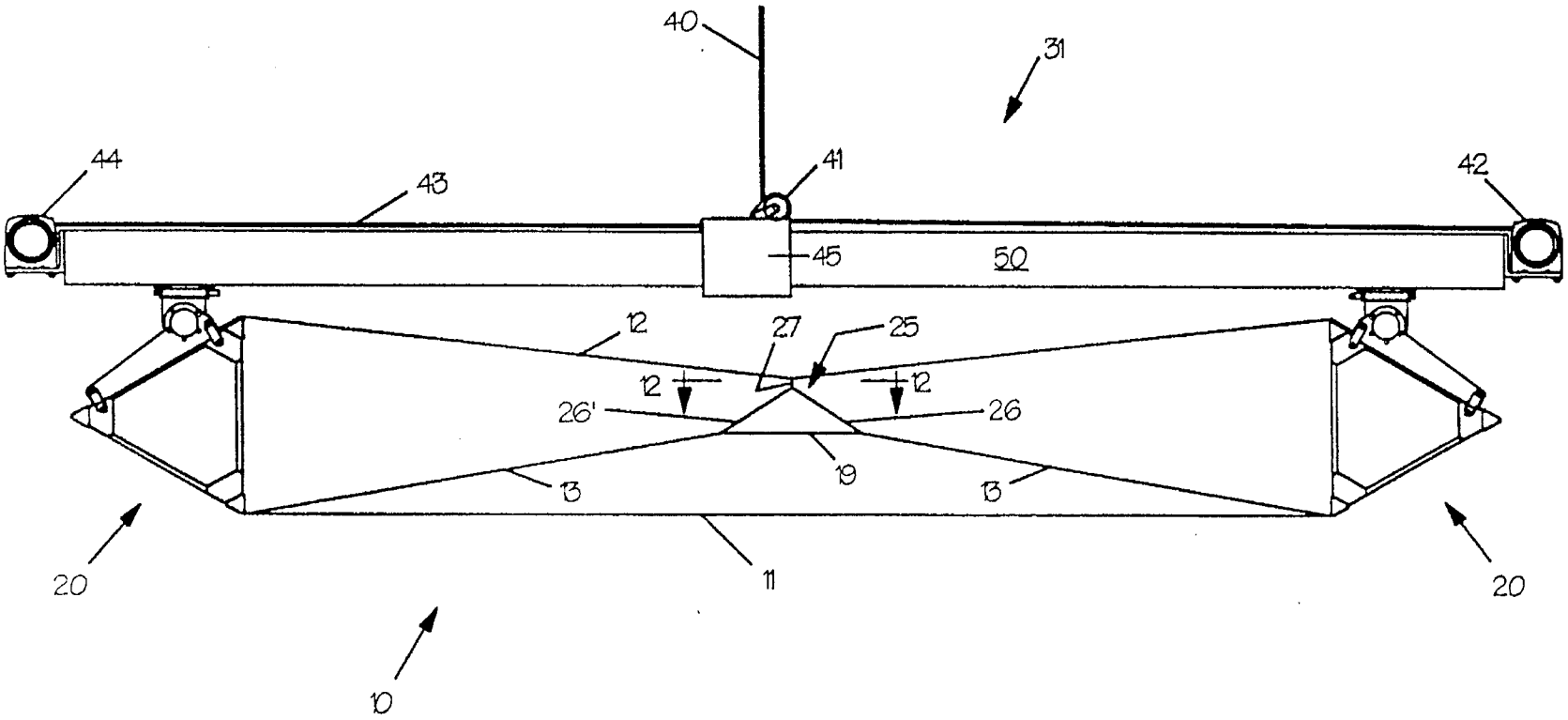
FIG. 1 is a schematic cross section of a preferred embodiment of the invention.

Referring now to the drawings wherein like numbers indicate like parts, a best mode of carrying out the invention is illustrated by reference to specific embodiments depicted in the drawings.

The invention may best be understood by reference first to what has gone before. FIG. 11 depicts a typical arrangement for a known banklight apparatus 1 having a curved reflecting surface 2 and light source 3, bottom reflector 4 and diffuser 5. In this known banklight apparatus, light source 3 emits rays of light, selectively shown as arrows in FIG. 1 which are prevented from downward spillage by bottom reflector 4 and generally upwardly directed to reflect off of reflector 2. Depending upon the curvature of reflector 2, that is circular, ellipsoidal, or parabolic, the nature of the direction and focusing of reflected light rays will vary. Typically, the required thickness of such an apparatus with respect to its width is in a ratio greater than 1:2 in order to effectively disperse the light across diffuser 5. Where an attempt is made to lower the height to width ratio by moving the light source line closer to the surface than the focal line would be, even greater nonuniform distribution of light reflection occurs. Known banklight apparati attempt to correct this nonuniform reflection from reflector 2 with a diffusing material 5 which to some extent causes a mixing or blending or various incident light rays.

Figure 10:
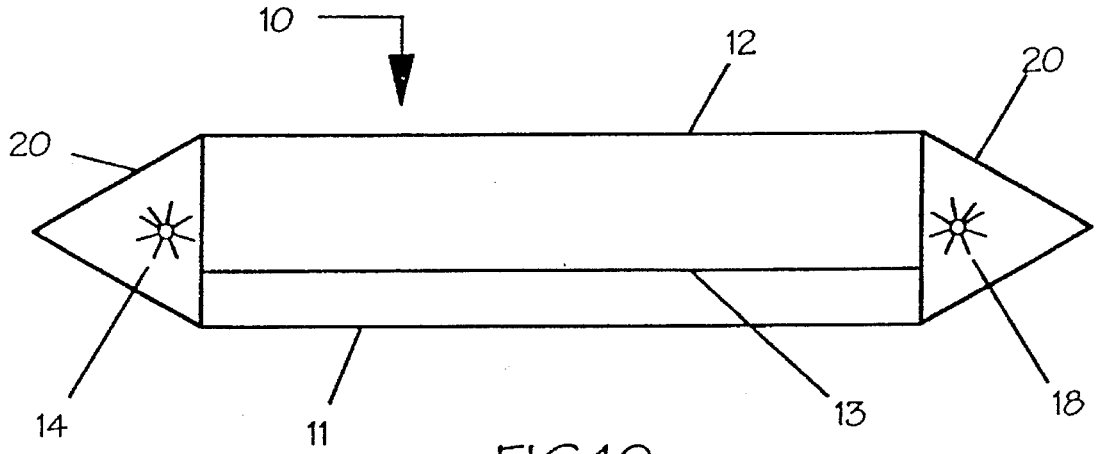
FIG. 10 is a schematic illustration of the basic apparatus of the invention.

The basic apparatus of the invention as shown in FIG. 10. Bank light 10 having an open generally rectangular framework 20 has stretched across the rear of the frame a reflecting panel 12, at either side of which are disposed first and second light source rows 14 and 18 respectively. Across the front of the framework is stretched a primary diffusing panel 11. In between reflecting panel 12 and primary diffusing panel 11 is secondary diffuser 13. Light from light source rows 14 and 18 is reflected from reflecting panel 12 onto secondary diffuser 13. Some light which strikes secondary diffuser 13 is reflected back to reflecting panel 12, and this re-reflected light adds to the homogeneity, or uniformity, of light distribution along secondary diffuser 13. Light which passes through secondary diffuser 13 is then available to illuminate primary diffusing panel 11.

Reflecting panel 12 is preferably a stretchable cloth material so that it can be stretched across the back of frame 20 to produce a smooth, or nearly smooth, reflecting surface. However other reflective materials may be substituted without departing from the scope of the invention. A type of rip stop nylon coated with aluminized polyurethane called "CC Transfer" and available from Hirsch Industries has been found to work well as reflecting panel material. Aluminized mylar has better reflectivity but does not appear to hold up to repeated stretching. In order to promote more uniform distribution and diffusion of reflective light the reflecting panel material is preferably embossed all over with a uniformly distributed pattern of raised dots. Aluminized KEVLAR™ with vacuum deposited aluminum could also be used, but it is believed that this material would be hard to emboss. Secondary diffuser 13 may be made from three quarter ounce spinnaker cloth available from Challenge Sail, and is preferably made of calendarized NYLON, DACRON, or a blend, to help prevent direct light spots from showing through the diffuser. The primary diffuser is preferably a two ounce white dacron preferably with both a high thread count and calendarized as well. A 400 thread count is preferred, and the tighter the thread count the better. This particular two ounce white dacron is imported by Wide Fabrics in Los Angeles, Calif.

Light source rows 14 and 18 are preferably rows of spaced tungsten lamps of the quartz halogen variety, xenon flashtubes, or HMI lamps (or any short arc, or other arc, discharge lamps made for the film industry or other purposes and well known to those skilled in the art), but may also even be a series of fluorescent tubes or other lamps known in the industry. It has been found that Sylvania or General Electric quartz halogen lamps with tungsten filaments on centers spaced between twelve and twenty four inches apart along the respective light rows have provided good results. Lamps meeting ANSI code FCM are preferred, but General Electric model Q250MC 250 watt lamps and Sylvania model 500Q 500 watt lamps also work well. A particular light row is best provided with uniform lamping and spacing, depending however on the job application and the banklight size. An additional advantage may be had by employing xenon photo flashtubes instead of quartz halogen lamps.

Figure 4:
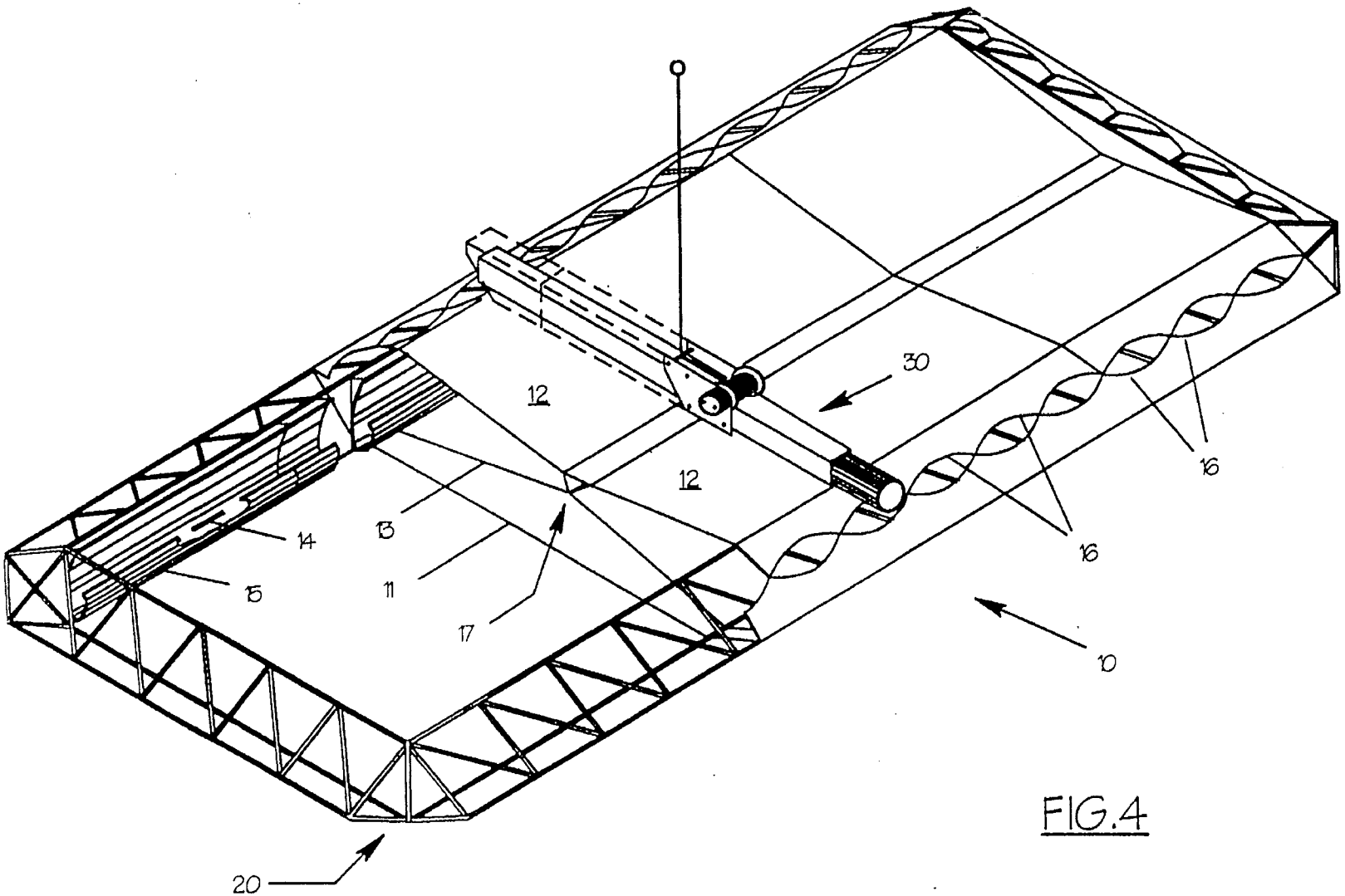
FIG. 4 is an isometric view of an assembled apparatus of the invention in an alternate embodiment with some of the stretched panel material cut away to reveal interior detail.
Figure 5:
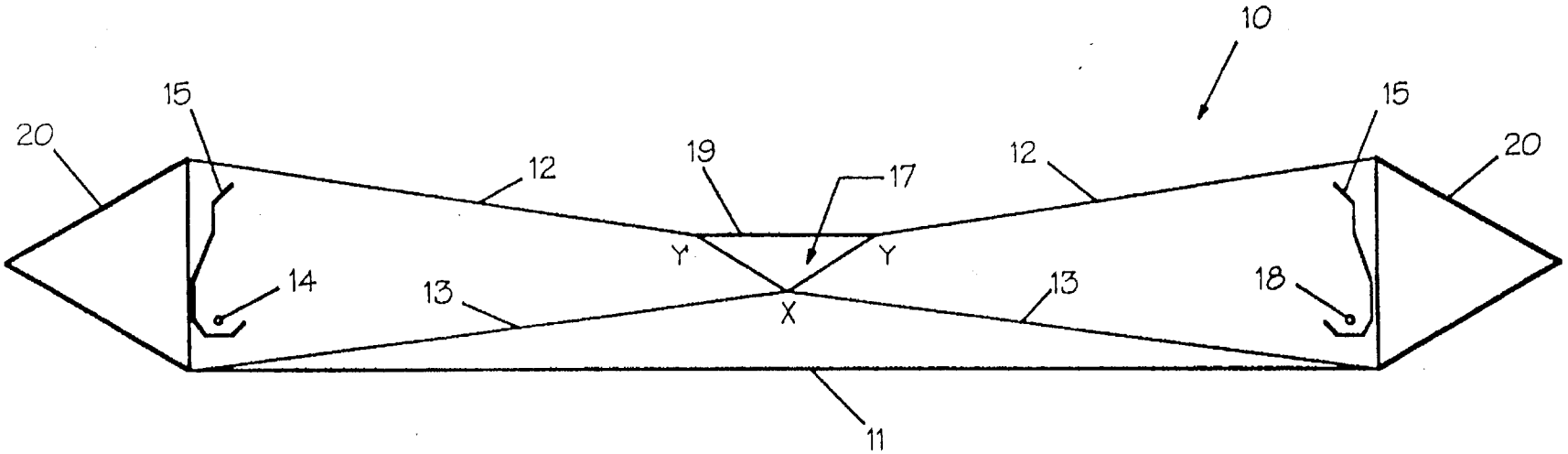
FIG. 5 is a schematic cross sectional view of the apparatus of the FIG. 4.

In an earlier, prototypical embodiment, illustrated in FIGS. 4 and 5, an improvement to the basic design of the invention was tested. A more or less rectangularly arranged triangularly cross sectioned truss frame 20, suspended from a suspension system 30 acts as the framework for the reflecting and diffusing panels of the invention and as mounting platform for the light rows. Disposed along both of the long sides of frame 20 are reflecting troths 15 within which are disposed first light source row 14 and second light source row 18. Light sources 14 and 18 and reflectors 15 are designed to illuminate and direct light primarily to the reflecting panel 12, and in addition to that part of reflecting panel 12 lying between points y' and x, and y and x in FIG. 5.

Light impinging upon reflecting panel 12 is reflected downwardly to secondary diffuser 13 where some of the light incident to the upper surface of secondary diffuser 13 is reflected back to reflecting panel 12, and then re-reflected back down to secondary diffuser 13, and the rest of the light incident to secondary diffuser 13 is passed through to impinge upon the upper surface of primary diffusing panel 11. Secondary diffuser materials are preferably selected so that something approximating half of the light incident to the surface of secondary diffuser 13 is typically reflected backwardly. This bouncing of light between reflecting panel 12 and secondary diffuser 13 creates in and of itself a virtually first order approximation of uniformly distributed light, assuming that the intensity of the illumination from first light source 14 and second light source 18 are substantially equal. Light then strikes primary diffusing panel 11 in something already approximating uniform diffusion, and thus light emitted forwardly from primary diffusing panel 11 is assured of being nearly uniform. Light measurements across the width of primary diffusing panel 11, even in this earlier embodiment, indicate that the light intensity, where both light sources are at equal intensities, are uniform to within ±15%, and in preferred embodiments to within ±10%, as illustrated by the solid line at the top of the graph in FIG. 3.

The embodiment in FIGS. 4 and 5 differs principally from that illustrated schematically in FIG. 10 in the presence of yoke 17. Secondary diffuser 13 and reflecting panel 12 are attached to one another in the region of their longitudinal centers by yoke 17. Yoke 17 is positioned and dimensioned in such a way that reflecting panel 12 is angled from the frame edges toward the center at a catenary angle below the horizontal. In like manner, secondary diffuser 13 is angled upwardly from the horizontal. Yoke 17 is connected to secondary diffusing panel 13, typically by a sliding closure at point x in FIG. 5 and is comprised of the central portions of reflecting panel 12 together with a yoking panel 19 to comprise yoke 17. Yoking panel 19 is joined along two parallel lines to reflecting panel 12, preferably with sliding closures such as zippers, but may also be sewn or fastened in some other manner. Yoking panel 19 pulls reflecting panel 12 into the yoke configuration 17 schematically illustrated in FIG. 5 between points yxy'. It should be noted for later comparison with other embodiments that the portions of yoke 17 between x and y' and between x and y are, in this embodiment, actually portions of reflecting panel 12.

Figure 3:
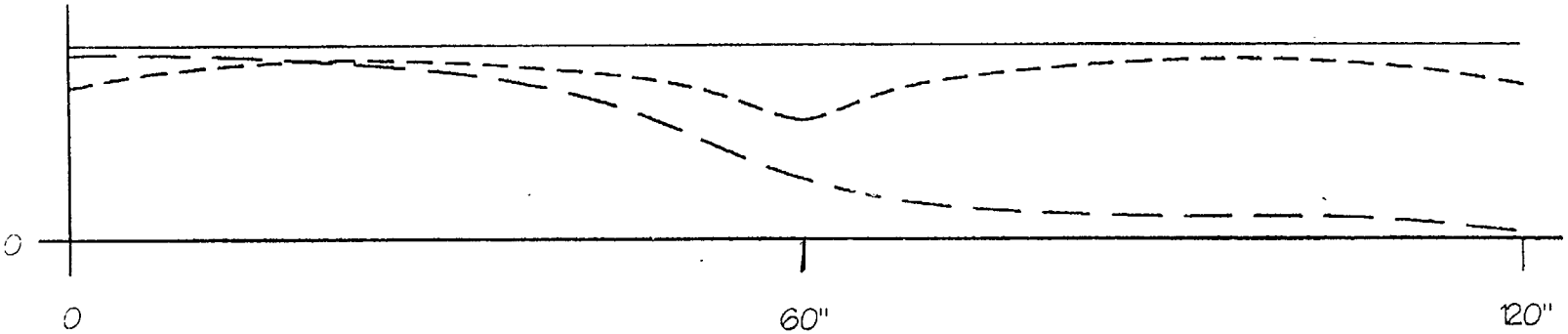
FIG. 3 is a combined graph of light intensities measured across the width of two alternate embodiments of the apparatus of the invention.

The basic triangularly cross sectioned structure of yoke 17 was selected initially in favor of merely joining reflecting panel 12 and secondary diffuser 13 along a single longitudinally centered seam, because the centered seam method of joining the two panels produced a plot of light intensity across the width of primary diffusing panel 11 illustrated by the dotted line in the graph of FIG. 3. That is, even with equal intensity light sources at either side of the reflecting panel 12, a marked "dip" in intensity could be measured in the center portion of primary diffusing panel 11. Using yoke 17 and the design illustrated in FIGS. 4 and 5 produced the solid line intensity graph at the upper portion of the graph of the FIG. 3. This embodiment however did not prove optimal for applications where one light source was run at a lower intensity than the other light source in order to produce a gradation of light intensity across the width of the primary diffusing panel 11. When this is attempted with the embodiment illustrated in FIG. 5, the broken line of the graph of FIG. 3 is the resultant intensity curve. That is, the intensities of light measured across the center of primary diffusing panel 11 drop drastically rather than smoothly with this configuration.

Figure 7:
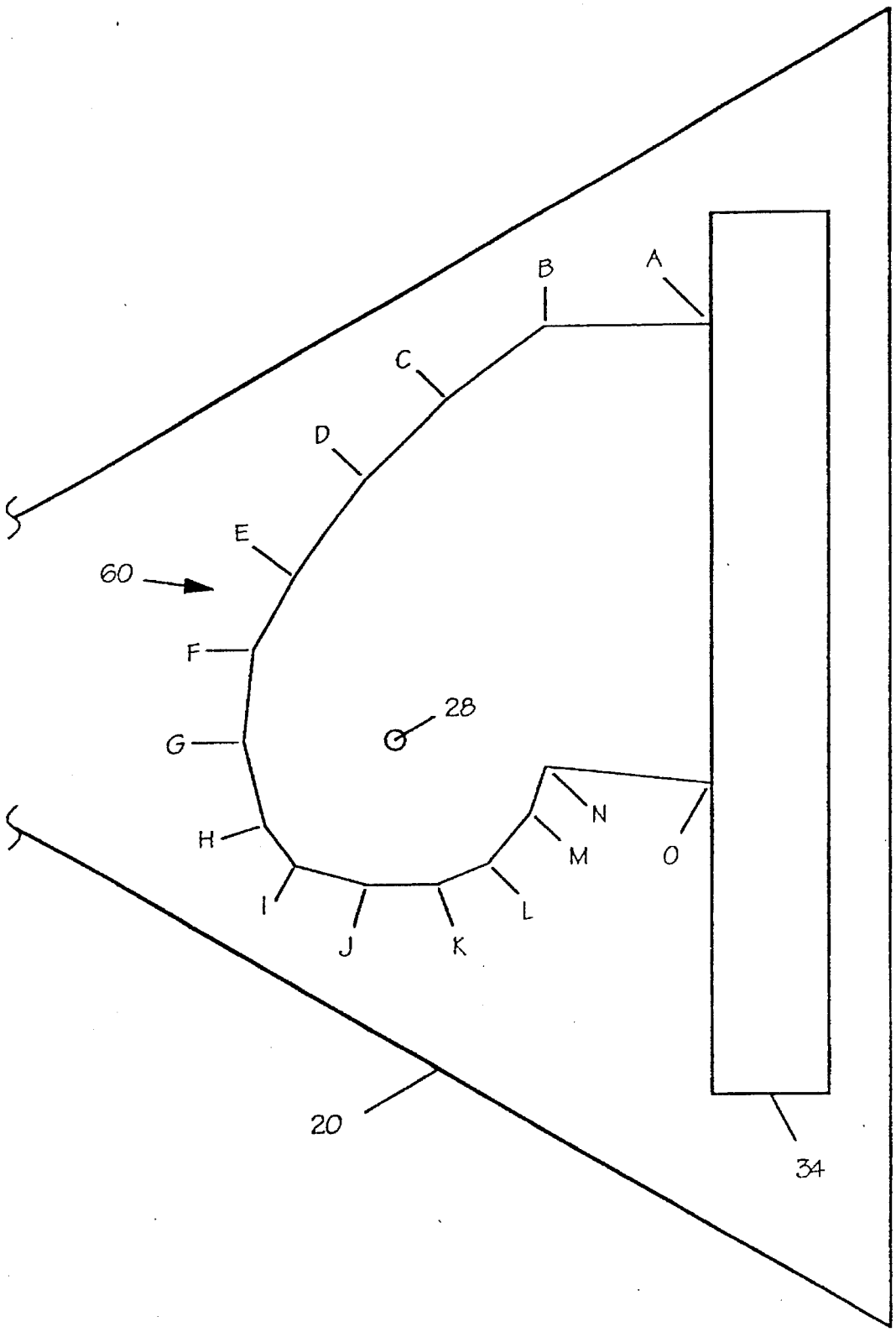
FIG. 7 is a schematic cross sectional detail of the apparatus of FIG. 1 depicting a preferred placement of light source row and reflector.

FIG. 1 illustrates a preferred embodiment of the apparatus of the invention. It should be noted that FIG. 1 is schematic in nature and also does not illustrate the preferred positioning of light source rows or reflectors which are illustrated in FIGS. 7 and 9. In FIG. 1, primary diffusing panel 11 is essentially the same as depicted in FIGS. 4 and 5. However, owing to an improved design of yoke 25 over that of yoke 17, the shape and geometry of reflecting panel 12 and secondary diffuser 13 differ substantially from that disclosed in the embodiment shown in FIGS. 4 and 5. Also illustrated in FIG. 1 is a preferred embodiment of the suspension system 31 of the invention.

Yoke 25 is comprised of yoke panels 26 and 26' and a portion of secondary diffuser 13 lying between the outer edges of panels 26 and 26'. Yoke 25 also has yoke connector 27 to attach the apex of yoke 25 to the longitudinal centerline of reflecting panel 12. Yoke connector 27 is preferably a slide closure, such as a Number 10 nylon molded zipper, for ease of attachment and disconnection of yoke 25 from reflecting panel 12. However other methods of attachment of yoke 25 to reflecting panel 12, including permanent stitching, may also be used. In this embodiment, yoke panel 19 is not necessarily a separate piece of material, but is simply that portion of secondary diffuser 13 which lies between the outer edges of yoke panels 26 and 26'.

Figure 12:
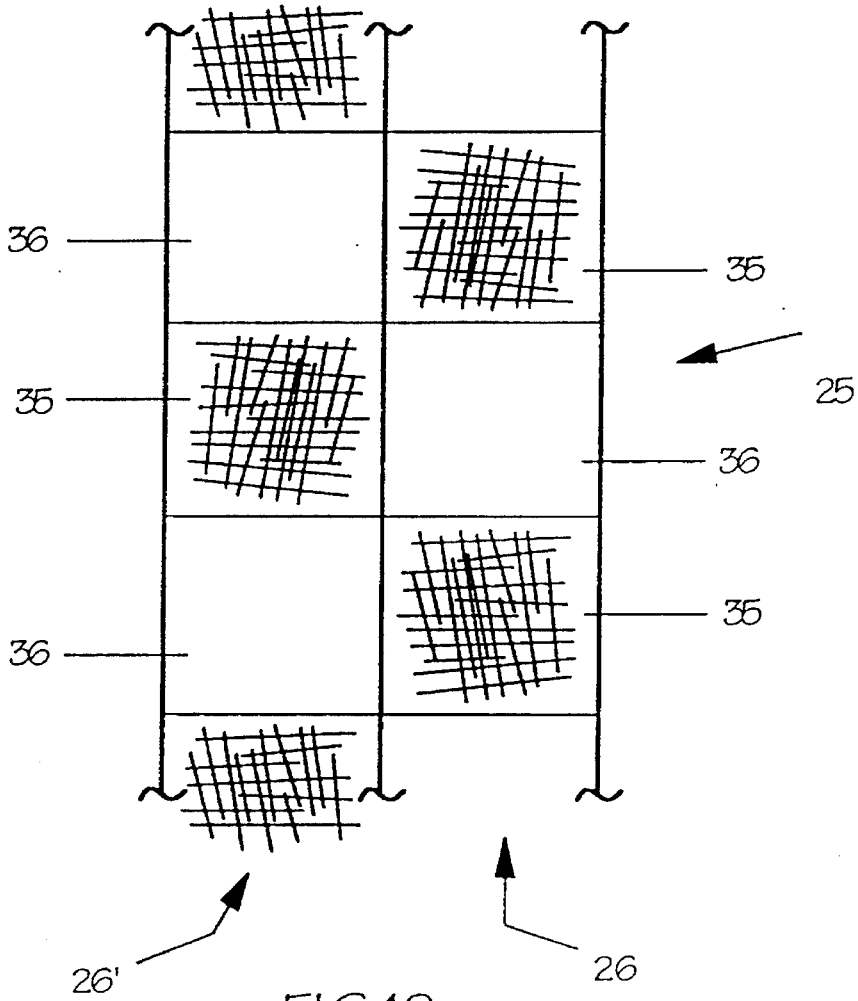
FIG. 12 is a partial plan view of Yoke 25 taken along line 12—12 of FIG. 1.

In preferred embodiments, yoke panels 26 and 26', more clearly illustrated in FIG. 12, are actually comprised of subsections of material, alternating between a mesh cloth and a diffusing material similar to that used for secondary diffuser 13. This alternation of mesh with nonmesh cloth, together with the opposition of a mesh section for instance on panel 26, with a nonmesh section on panel 26', allows cross convectional airflow while at the same time substantially baffling light from crossing over from one side of the banklight to the other. Preferred yoke panels 26 and 26' will employ mesh sections approximately half the length of the nonmesh sections, with one foot long mesh sections preferred. A preferred mesh cloth is available from Fablok Mills, fabric number 9622. This is a dacron knitted mesh which is preferably calendarized in order to bond the thread intersection to prevent distortion of the mesh under tension.

Figure 2:
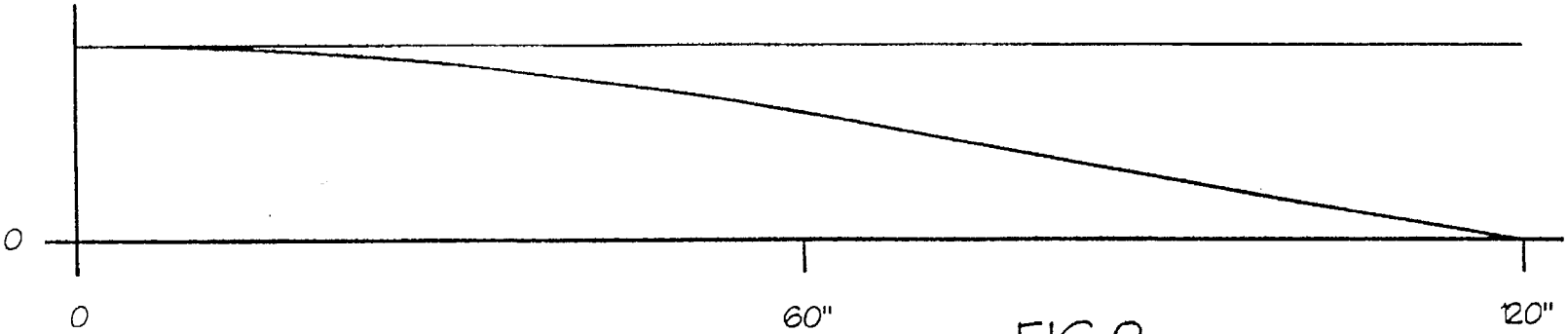
FIG. 2 is a graph of light intensity measured across the width of a preferred embodiment of the apparatus of the invention for two different ratios of light intensity between the two light source rows of the apparatus.

The design of yoke 25, which is inverted with respect to yoke 17 of FIGS. 4 and 5, is used in conjunction (as illustrated in FIGS. 7 and 9) with a more rearward placement of the reflector associated with the light source row 28. This rearward and outer placement of the light source rows and the design of yoke 25 yields improved performance over the earlier design, principally in modes of operation where different intensities of light are used for the respective light source rows. In this gradation mode, yoke panel 19 is used to blend the different intensifies across secondary diffuser 13 to achieve a more constant change in surface intensity along diffusing panel 11. Graphs of intensity measurements using the embodiment shown in FIG. 1 are illustrated in the graph of FIG. 2. The solid straight line represents measurements of intensities across diffusing panel 11 when the intensifies of the two light sources are equal, and the sloped line represents graph of intensities across the width of diffusing panel 11 when one light source is at zero intensity and the other light source is at full intensity. It will be appreciated that the slope of the line in this latter case is nearly flat as compared to the broken line in the graph in FIG. 3 for the earlier embodiment.

Of the two reflector arrangements shown in FIGS. 7 and 9, the one illustrated in FIG. 7 is preferred in that the more precisely controlled shape of reflector 60 in FIG. 7 allows greater control of the light directed ultimately toward the center of primary diffusing panel 11. However the reflector 22 of FIG. 9 also yields satisfactory performance. Reflector 22 is typically ellipsoidal and employs flap 23 to reflect light back down to the outer edges of primary diffuser 11, and bottom reflector 4 to prevent direct light spill to the secondary diffuser 13. For cooling, air gap 21 is provided.

Preferred dimensions for reflector 60 may be had by reference to Table I below. The letters in the table correspond to the lettered intersection points of the planes of reflector 60 in FIG. 7 and the numbers in the table correspond to grid references on a standard x-y coordinate system where the zero datum point reference is the centerline of light source row 28. Thus in Table I the numbers for point A are −16x and 19y. This means that on any standard graph paper, with an arbitrary point selected for the centerline of light source row 28, the corresponding datum points for reflector may be plotted. A reflector template may then be laid out from the graph paper plot of the data from Table I. Actual dimensions may then be scaled from the graph paper. For example in a preferred embodiment, with graph paper spacings of ¼ inch, every four spaces will equal one inch and the template derived will be full scale for a banklight with 22 inch side triangular truss sections. The template will represent the inside dimensions of the reflector. A reflector may then be formed by using standard sheet metal brake techniques. A preferred material for reflector 60 is COILZAK™ type one specular lighting sheeting (83% specular or better preferred).

TABLE I

| | x coord | y coord |
|---|---|---|
| A | −16 | 19 |
| B | −8 | 19 |
| C | −3 | 15.5 |
| D | 1 | 11.5 |
| E | 4 | 7.5 |
| F | 5.5 | 4 |
| G | 6 | 0 |
| H | 5 | −4 |
| I | 3.5 | −6 |
| J | 0 | −7 |
| K | −3 | −7 |
| L | −5.5 | −6 |
| M | −7 | −4 |
| N | −8 | −1.5 |
| O | −16 | −2.5 |

In the reflector positioning shown in FIG. 7 media frame 34 is also illustrated. Media frame 34 may be an adaption of the common gel frame or a frame to hold various color filters well known in the art. Where light sources in the apparatus of the invention are thus filtered or otherwise colored, and particularly where each light source has a different color, cross fading the two light sources will not only produce a gradation of light intensity across primary diffusing panel 11, it will also produce a gradation in color. In this way, for instance, an effect such as a dark blue to lighter gold gradation similar to the effect found in nature after a sunset with a cloudless day may be achieved to photographic advantage. Also where block control of the lamps along any particular light source row is effected, as will be readily understood by those skilled in the art, it will also be possible by controlling intensities along the row to create end to end gradations in light intensity as well as spot enhancement.

As an illustration of a proven high performance banklight configuration, the following dimensions are provided. For a generally rectangularly truss frame with triangular cross sectioned truss sections 22 inches on a side, the primary diffusing panel 11 is 121 inches wide, the secondary diffuser is 122.5 inches wide (including the 16 inch portion of secondary diffuser 13 which has been referred to herein as yoke panel 19), and reflecting panel 12 is 121.7 inches wide. Yoke panels 26 and 26' have a width of 9.44 inches each. And the distance between yoke panel edges at their jointure with secondary diffuser 13 to the outer edge of secondary diffuser 13 is 53.25 inches on each side of yoke 25. Of course other dimensions may be employed without departing from the scope of the invention, and the above dimensions are illustrative only.

Figure 6:
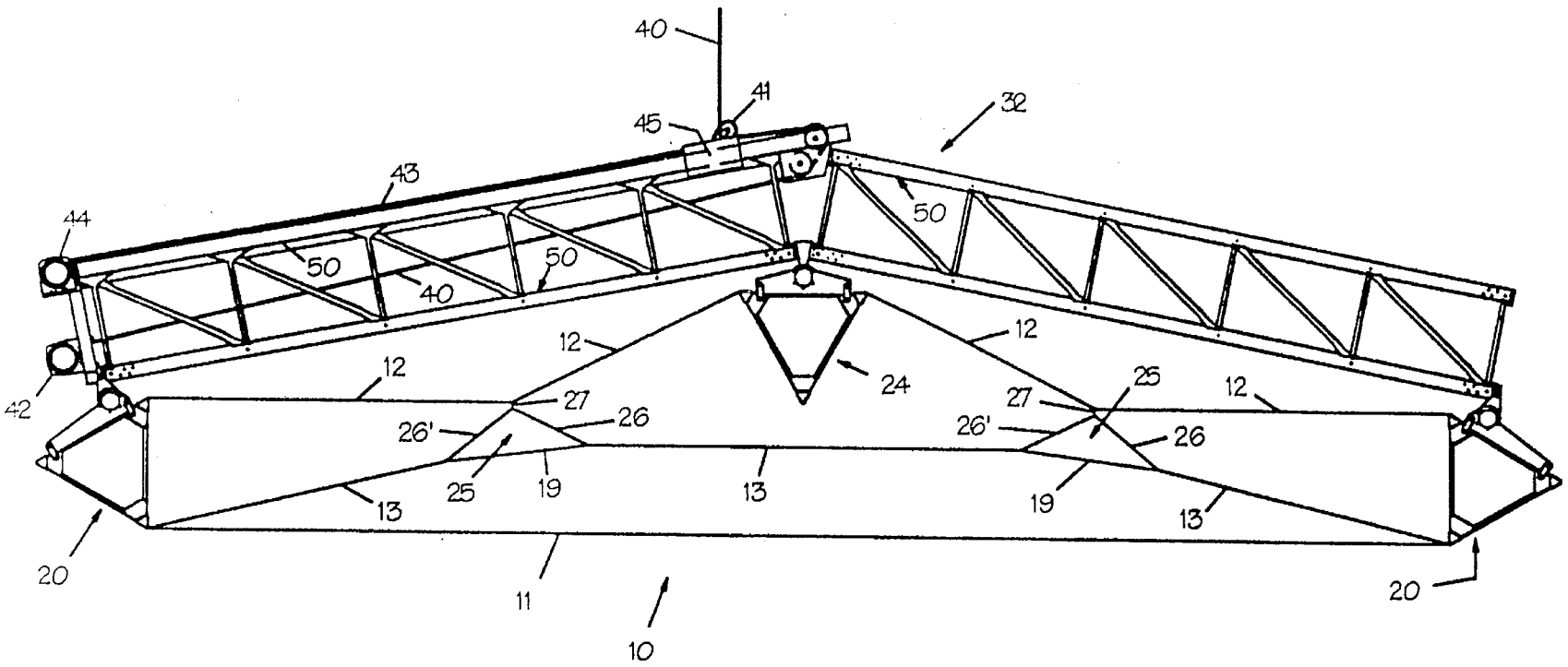
FIG. 6 is a schematic cross section of an alternate embodiment of the invention shown in FIG. 1 employing a central truss member and third light source row, and depicting an alternate embodiment of the suspension cross piece of FIG. 1.

Another embodiment of the apparatus of the invention is schematically depicted in cross section in FIG. 6. This embodiment is particularly well suited to very wide banklights in the range of 20 feet in width. The apparatus in FIG. 6 may be conceived of as two of the panel assemblies illustrated in FIG. 1 joined side to side in a central region of the apparatus illustrated in FIG. 6. In order to effect such a "joining" of the panel assemblies, while assuring structural integrity, and in order to preserve the virtual uniform distribution of reflected and diffused light, a longitudinal truss frame member 24 is employed in the central and midline portion of the banklight apparatus 10. In fact, single primary diffusing panel 11 is stretched between frame members 20, and a single secondary diffuser 13 is stretched between frame members 20. However two reflecting panel pieces 12 and two yokes 25 are employed, where each reflecting panel 12 is stretched between one frame member 20 and central frame member 24. Geometric and illumination considerations differ from the embodiment disclosed in FIG. 1 however, notably in the necessity of having an inner portion of each of reflecting panels 12 at a steeper angle with respect to primary diffusing panel 11. Also a light source row is preferably placed inside the structure of truss member 24 in order to provide full illumination for the central portion of this wider embodiment. That illuminating structure is further discussed below in the paragraph making reference to FIG. 8.

A suitable geometry may be established in this wide embodiment by employing a primary diffusing panel which is 219 inches wide, a secondary diffuser which is 222 inches wide, two reflecting panels which are each 103.3 inches wide,and two yokes 25 having panels 26 and 26' each 14.15 inches wide and attached to secondary diffuser 13 so as to create apparent yoke panel 19 widths of 24 inches between legs 26 and 26', with 73 inches across the central portion between yokes 25, and 50.5 inches on either outer side of diffuser 13 between frame 20 and yokes 25. Yoke link 27 for each of the yokes is attached to divide the respective reflecting panels 12 into apparent panel widths, proceeding from left to right across the drawing toward the central truss member and thence symmetrically to the other frame member of 60 inches and 43.3 inches respectively. Frame 20 is also 22 inches on a side.

The placement of light central light source 28 and a gull wing reflector 29 is illustrated in FIG. 8 for the apparatus shown in FIG. 6. The bottom reflector 33 also functions to prevent bottom spill of light from light source 28 directly downward to secondary diffuser 13 and primary diffusing panel 11. Gull wing reflector 29 and bottom reflector 33 both serve to aim and direct the light from light source 28 generally to the sides of truss member 24 for reflection from reflecting panel 12 and also, where reflected from reflectors 29, downwardly to secondary diffuser 13 and outwardly primarily to the area of panel 26. Gull wing reflector 29 sections C–D and D–E are preferably embossed in the "hammertone" style. As with the data for reflector 60 is FIG. 7, the data from Table II below will serve to particularly describe a preferred embodiment of gull wing reflector 29 and bottom reflector 33 in FIG. 8.

TABLE II

| | x coord | y coord |
|---|---|---|
| A | 0 | 13.5 |
| B | −4 | 16 |
| C | −9 | 18 |
| D | −14 | 17 |
| E | −18 | 15 |
| H | 0 | −5 |
| I | −2 | −6 |
| J | −7 | −4 |

Figure 13:
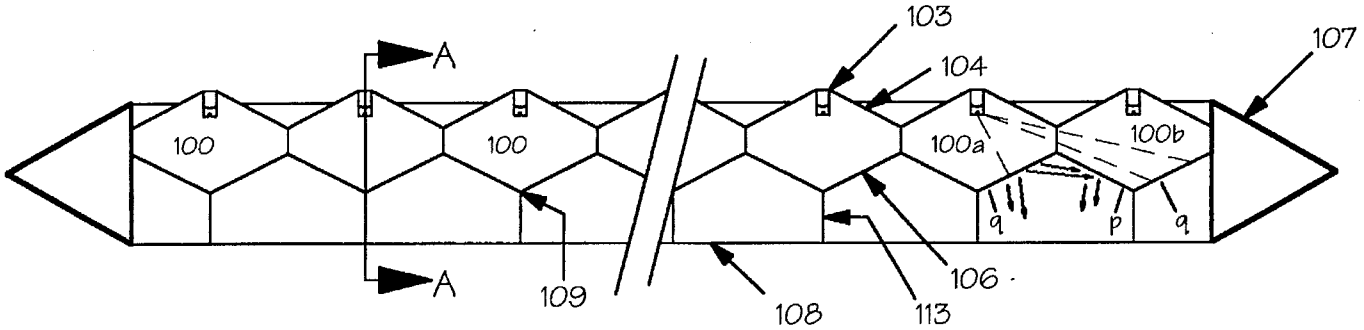
FIG. 13 is a schematic cross section of a preferred enhanced gradation embodiment of the invention with gradation cells, taken along line B—B of FIG. 14.
Figure 14:
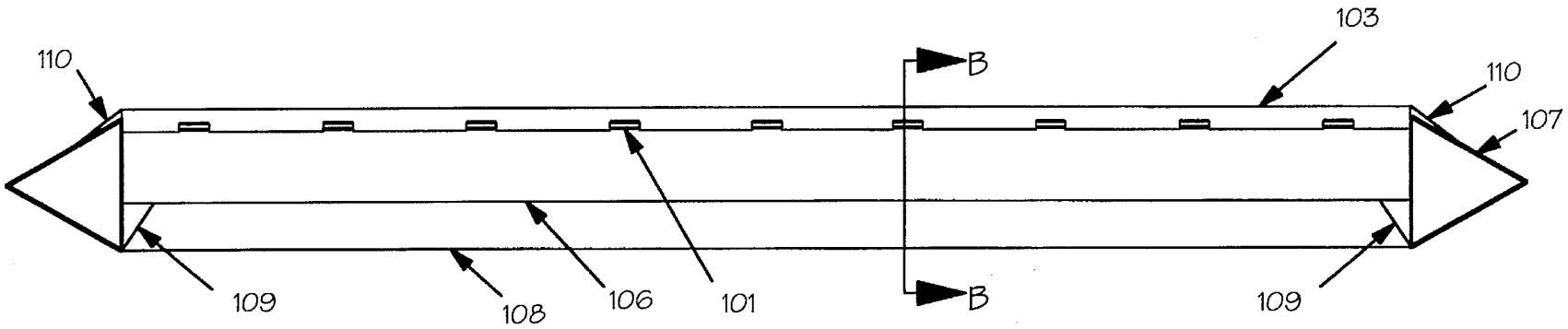
FIG. 14 is a schematic cross section of the embodiment of FIG. 13, taken along line A—A of FIG. 13.
Figure 15:
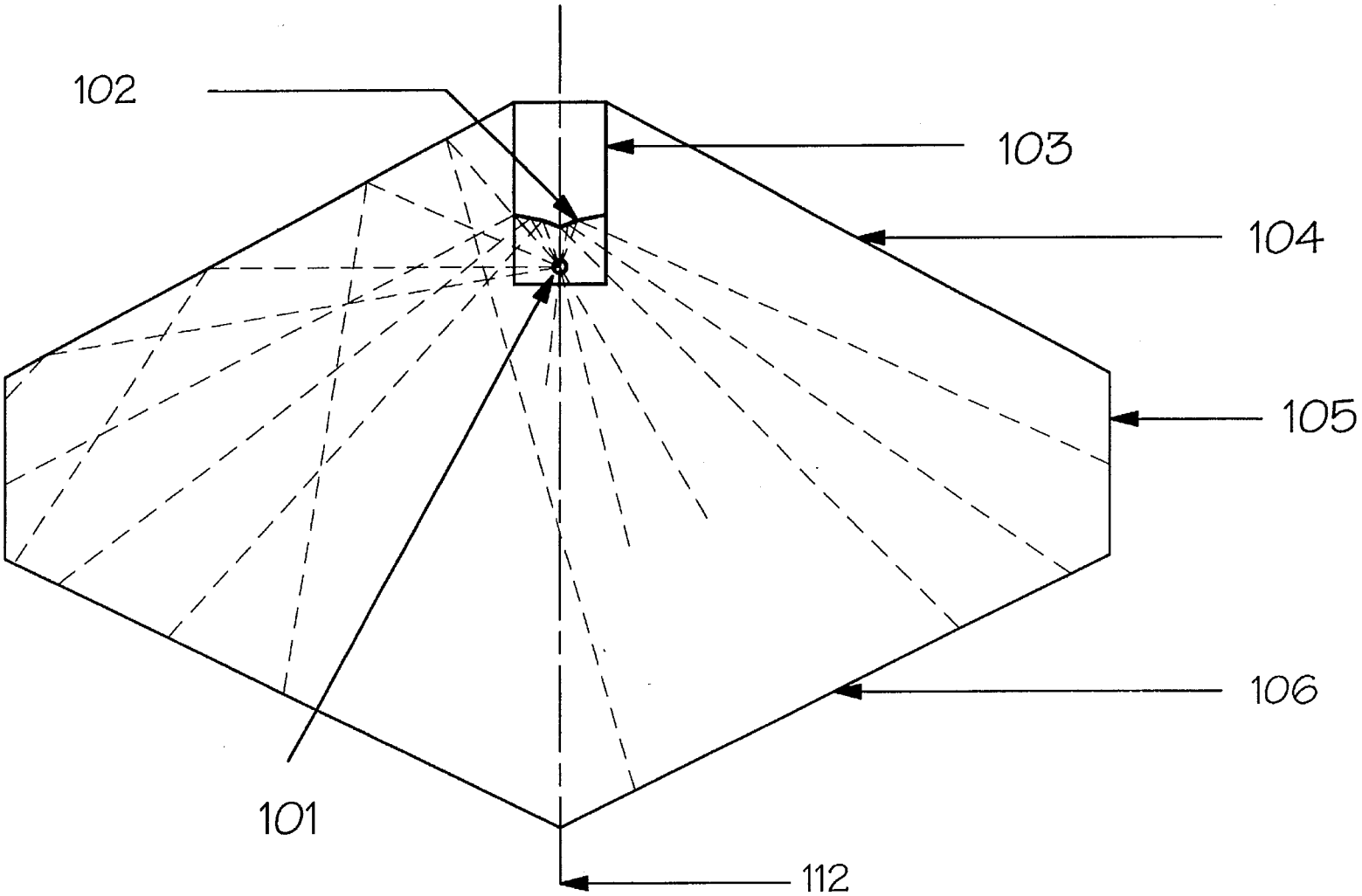
FIG. 15 is a schematic cross sectional detail of the gradation cell of the invention.

In FIGS. 13–15, another preferred embodiment of the invention is illustrated. Unless otherwise varied herein, structural features and specifications of previously discussed embodiments apply generally to the discussion of this embodiment as well, and for the sake of brevity are incorporated herein by this reference as if fully set forth.

This embodiment is particularly well adapted to producing both variegated and evenly gradated light intensities at the primary diffuser, although to some extent both of these features are possible in the embodiments discussed above as well. In this embodiment the ability of the banklight to vary color and/or intensity of the diffuser in localized subareas, independently of the intensity or color of the rest of diffuser, is heightened and augmented by structural aspects not associated with the previously discussed embodiments. In this embodiment, there can be two, three, or more different intensity levels or colors, each in different areas of the diffuser. Nonetheless, even with pronounced variegation of intensity or color at the primary diffuser 108, this embodiment allows the boundaries between the locally variegated areas to be smoothly gradated, thus achieving an even blending of relatively more dark areas with adjacent areas of higher intensity, while at the same time achieving local area sizes as small as 1 to 5% of the total diffuser area.

A plurality of independently controllable light sources 101 are spaced evenly along multiple light bars 103 which, in preferred embodiments, are run across the short axis of the banklight frame 107. The invention will also work with the light bars running parallel to the long axis of the frame 107. In preferred embodiments, the light bars 103 are spaced 24" apart on center, although this dimension may vary depending on lamp selection and reflector design in ways believed to be well understood in the art. Preferred light sources are ANSI code FCM tungsten halogen, R7S double ended, linear element style lamps and, while the exact number of lamps used and their spacing on the light bar will depend on the type of lamp used, 8–9 lamps of the preferred type evenly spaced will effectively equip a light bar 18 feet long.

The light bar 103 is also a structural member strong enough to support the lamps 101, reflectors 102, and still serve as anchor points for reflecting panel 104. It should be noted that although the lamp 101 and its associated reflector 102 may be housed and protected inside the light bar 103, the walls of the light bar adjacent the lamp and reflector are necessarily cut away to allow passage of light. Exact dimensions of these cut outs will depend on the lamp used, as will be appreciated by those skilled in the art. The reflector 102 associated with each lamp 101 is preferably of a gull wing shape such as disclosed in FIG. 8 and comprised of a high quality metal reflector with a specular finish, such as for instance the reflector material described previously in regard to FIG. 7. The reflector may be aluminum, or one of the newer silver coated steel materials. The reflector is shaped and positioned to redirect light coming upward off the lamp to the general area of the dihedral intersection of side wall diffusing panel 105 and secondary diffuser 106 (see below), thus achieving more even illumination of secondary diffuser 106. As noted above with respect to other embodiments, the particular shape and position best suited to this goal may be readily derived by persons skilled in the art. Lamps are positioned in the plane of symmetry 112 of the respective gradation cell 100, and preferably employ no bottom reflector, as the overall reflection/diffusion characteristics of the gradation cell 100 make such a reflector less desirable.

Conventional means for individually controlling the intensity and/or color of each lamp in each light bar may be housed in or on the light bars themselves (such conventional means not illustrated), as will be readily appreciated by those skilled in the art. Alternatively, some or all of such conventional control and switching apparatus and circuitry may be physically located remotely from the banklight, and connected to it by appropriate conventional electrical cabling. In preferred embodiments, what is required at minimum is dimming and switching apparatus and control circuitry, which may be computerized, so that each lamp may be selectively dimmed (such as by well known triac/phase angle firing methods) independently of the others on the same light bar, and independently of the other light bars, to selectively produce at the diffuser either variegated or gradated patterns of light intensity and color, or uniform light intensity, at will.

Reflecting panel 104 is stretched from one side of frame 107 to the other across the backs of light bars 103. Grommets or ties, or other suitable attachment means, are provided in reflecting panel 104 at points where it will lie along each light bar for securing the reflecting panel in place and for preventing shifting across each bar in the axis perpendicular to the light bars. Straps 110, or other means of applying tension, are also provided for securing reflecting panel 104 from undue movement in the direction along the light bar.

Reflecting panel 104 is preferably comprised of a woven nylon fabric, as previously discussed above, with an aluminized coating, or alternatively a white coating such as polyurethane, or a combination of aluminum with white polyurethane dots on top of the aluminum. On either side of each light bar 103, reflecting panel 104 is held preferably at a 60 degree angle relative to gradation cell (see below) plane of symmetry 112 for best results in reflecting direct light from lamp 101 onto the portions of secondary diffuser 106 below it and onto the side wall diffusing panels of the cell. Other acute angle values will also serve without departing from the scope of the invention.

Holding reflecting panel 104 at this angle on each side of light bar 103 is a series of side wall diffusing panels 105 which are temporarily (as by sliding closure) or permanently connected in symmetrical array to reflecting panel 104 along each rear edge of side wall diffusing panel 105 and at the midline of the portion of reflecting panel 104 extending between each successive pair of light bars 103. At its front edge, each side wall diffusing panel 105 is connected to secondary diffuser 106, preferably in such a way that each side wall diffusing panel 105 is parallel to the others, thus defining within the boundaries of the combination of a parallel pair of side wall diffusing panels 105, the pair of symmetrically angled portions of reflecting panel 104, and the portion of secondary diffuser 106 between the side walls, a gradation cell 100 which is symmetrical on either side of a plane passing through light source 101 and perpendicular to the plane of frame 107.

Both side wall diffusing panel 105 and secondary diffuser 106 are preferably comprised of the same ¾ ounce nylon spinnaker sail cloth. At the midline of each portion of secondary diffuser 106 defined by each successive pair of side wall diffusing panels 105, a tension tab 109 is connected at each end of gradation cell 100 and attached to frame 107 in such a way as to pull the midline of this portion of the secondary diffuser 106 forwardly toward the primary diffuser 108 to within a distance in preferred embodiments of about 8 inches from it, thus creating, for each gradation cell 100, a pair of angled panels, p and q, of secondary diffuser 106 as well. Tension tab 109 is preferably triangular in shape and sewn into the secondary diffuser at each end. The tension tab 109 is attached conventionally by ties or the equivalent to frame 107 and tensioned in order to tension the gradation cell 100 fabric and hold it in shape. In preferred embodiments, secondary diffuser 106 is dimensioned and cut, and tension tab 109 so placed and attached, that an obtuse angle is formed between each side wall diffusing panel 105 and its adjacent secondary diffuser plane. An angle of 126 degrees is preferred, though other angles will also serve.

In addition to serving as connector and spacer between reflecting panel 104 and secondary diffuser 106 to achieve preferred angles when gradation cell 100 is fully under tension, each side wall diffusing panel 105 also provides a "window" for diffuse light to spill over into the adjacent gradation cell, thus serving, at least in part, to moderate any differences in intensity between adjacent cells. For example, if one cell's lamps are fully "on", and the adjacent cell's lamps are fully "off" or dimmed, this "window" allows light to spill into the dark cell, thus limiting the contrast that might otherwise be present between the two cells to achieve a gradation of intensity between the two cells. In preferred embodiments, each side wall diffusing panel 105 is about 4 inches wide from back to front, and at either end of the long axis of the banklight the two outside side wall diffusing panels are conventionally attached to the frame 107, such as by means of a flap of material sewn along one of its edges to each such outer side wall panel and fastened at the other of its edges around an appropriate member of the frame with straps, ties, buckles or the like, back to the respective outer side wall.

Additional moderation of intensity or color differences, or gradation, is achieved as follows (referring, by way of example, to "cells" 100*a* and 100*b* in FIG. 13): as direct light from lamp 101 in gradation cell 100*a* strikes side wall diffusing panel 105 and is diffused on its way through and into gradation cell 100*b* (shown by broken lines), the light primarily strikes and affects the opposite secondary diffuser panel q in gradation cell 100*b*, not the secondary diffuser panel p in cell 100*b* adjacent to cell 100*a*. Thus, at least partly as a result of the obtuse angle between side wall diffusing panel 105 and secondary diffuser 106, any particular angled portion of secondary diffuser 106 in a gradation cell 100 will be more illuminated by the side wall diffusing panel 105 opposite it than by the side wall adjacent or above it. At the same time, panel p of cell 100*b* receives diffuse light radiating from the front of panel q of cell 100*a* (in the manner referred to above with respect to "white card" type reflection) and reflects a portion (approximately 50% as above noted for typical diffusion materials reflecting as well as transmitting incident light) of that light forwardly to primary diffuser 108 (light reflections shown as wavy arrows). Thus, while "adjacent" panels of the secondary diffuser 106 are not much illuminated by side walls above them, these such "adjacent" panels are effectively illuminated by the secondary diffuser panel on the other side of the respective side wall to thus fill in and complete the evenness of the gradation effect at the primary diffuser.

In both FIGS. 1 and 6 where suspension systems 31 and 32 respectively are illustrated, and although the beam structure of the suspension systems can vary significantly, the functioning of the invention of the suspension system is nonetheless the same. Suspension cable 40 (which comes down from some hanging device such as a crane or boom, not shown) passes around hangpoint roller 41 and is attached to winch 42. To the extent that the position of carriage 45 does not change along beam 50, the action of winch 42 will serve generally to raise or lower banklight 10 without changing its angled orientation. However, cable 43 attached at one end to carriage 45 and at the other to winch 44, together with the winching action of winch 44, provides a means of moving carriage 45 as follows: pulling cable 43 into winch 44 slides carriage 45 leftwardly in the illustration, effectively offsetting the pick point in the horizontal axis from the system center of inertia; as carriage 45 moves leftward, the system naturally changes the angle it hangs relative to the ground; secondarily as carriage 45 moves leftward, roller 41 is moved upwardly along cable 40 causing the entire system to move upwards, thus offsetting the downward movement of the system center of inertia caused by the leftward displacement of the pick point. All of the parts and specifications for the beam, carriage, rollers, cables, and winches will already be well known to those skilled in the art.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. A diffuse lighting gradation cell comprising:

a) a reflecting panel;

b) a light source disposed forwardly of said reflecting panel along a plane of symmetry of said gradation cell said light source disposed within a light bar which also supports the reflecting panel;

c) a secondary diffuser disposed forwardly of said reflecting panel and connected to said reflecting panel by a pair of side wall diffusing panels, said side wall diffusing panels symmetrically arrayed with respect to said plane of symmetry.

2. The gradation cell of claim 1 further comprising a plurality of light sources within said gradation cell, each said light source disposed forwardly of said reflecting panel along said light bar, and along a plane of symmetry of said gradation cell.

3. The gradation cell of claim 2 wherein said plurality of light sources are equally spaced along a light bar within said cell.

4. The gradation cell of claim 3 further comprising means to independently control a light intensity output of each said light source.

5. The gradation cell of claim 1 wherein said reflecting panel is disposed at acute angles to said plane of symmetry.

6. The gradation cell of claim 5 wherein said acute angles are 60 degrees.

7. The gradation cell of claim 1 wherein a dihedral of said side wall diffusing panel and said secondary diffuser is an obtuse angle.

8. The gradation cell of claim 7 wherein said obtuse angle is 126 degrees.

9. A banklight comprising:

a) reflecting panel; and b) secondary diffuser;

wherein said reflecting panel and said secondary diffuser are connected at regular intervals by a plurality of side wall diffusing panels to define therebetween a plurality of gradation cells, the banklight further comprising, within each gradation cell, a plurality of light sources disposed along a light bar, said light bar disposed along a plane of symmetry of said gradation cell, said light bar supporting the reflecting panel.

10. The banklight of claim 9 further comprising means to independently control a light intensity output of each said light source within any of said gradation cells.

11. The banklight of claim 9 further comprising a primary diffuser disposed forwardly of said secondary diffuser.

12. A banklight comprising: a reflecting panel, at least one diffuser, and a pair of light source rows each disposed along one of two opposite longer sides of said reflecting panel and between said reflecting panel and said diffuser, said light source rows comprising a plurality of individual light sources and means for individually controlling intensity of each light source for producing a gradated light intensity across a portion of said banklight;

wherein said reflecting panel and said diffuser, each has a longitudinal midportion and are connected along their respective longitudinal midportions.

* * * * *

UNITED STATES PATENT AND TRADEMARK OFFICE

CERTIFICATE OF CORRECTION

PATENT NO. : 5,493,481
DATED : February 20, 1996
INVENTOR(S) : Gregory P. Wiegand It is certified that error appears in the above-indentified patent and that said Letters Patent is hereby corrected as shown below:

In column 18, line 29, insert --a-- before "reflecting" to read " a reflecting panel; and ".
In column 18, line 30, insert --a-- before "secondary" to read " a secondary diffuser".

Signed and Sealed this

Eighteenth Day of June, 1996

*Attest:*

*Attesting Officer*

BRUCE LEHMAN

*Commissioner of Patents and Trademarks*